United States Patent [19]

Murai

[11] Patent Number: 4,866,484

[45] Date of Patent: Sep. 12, 1989

[54] COPIER SELECTIVELY OPERABLE IN SHEET-THROUGH MODE AND SHEET-STATIONARY MODE

[75] Inventor: Tatsuya Murai, Yokohama, Japan

[73] Assignee: Ricoh Company, Ltd., Tokyo, Japan

[21] Appl. No.: 241,369

[22] Filed: Sep. 7, 1988

[30] Foreign Application Priority Data

Sep. 8, 1987 [JP] Japan ..... 62-223172

[51] Int. Cl.[4] ..... G03G 15/00F1

[52] U.S. Cl. ..... 355/313; 355/235

[58] Field of Search ..... 355/235, 233, 241, 309, 355/313, 210, 77

[56] References Cited

U.S. PATENT DOCUMENTS 4,751,550 6/1988 Murakami ..... 355/313

4,771,317 9/1988 Katoh et al. ..... 355/313 X

*Primary Examiner*—R. L. Moses

*Attorney, Agent, or Firm*—Oblon, Spivak, McClelland, Maier & Neustadt

[57] ABSTRACT

A copier having an automatic document feeder and selectively operable in a sheet-through mode and a sheet-stationary mode. The sheet-through mode is automatically selected when only one copy is desired for each of documents while the sheet-stationary mode is automatically selected when two or more copies are desired for each of documents.

3 Claims, 4 Drawing Sheets

COPIER SELECTIVELY OPERABLE IN SHEET-THROUGH MODE AND SHEET-STATIONARY MODE

BACKGROUND OF THE INVENTION

The present invention relates to a copier in which the image surface of an original document being transported by an automatic document feeder (ADF) is sequentially scanned by optics for slit exporure. More particularly, the present invention is concerned with a copier which is automatically conditioned for a sheet-through mode or a sheet-stationary mode so as to perform effective copying with no regard to the desired number of copies per document.

A copier with an ADF is extensively used so that a number of documents in the form of sheets may be automatically fed one at a time to a glass platen of the copier, then scanned by optics, and then driven out of the copier to a documnt discharge tray. The ADF is usually made up of a document feed table to be loaded with a stack of documents, a separating device for separating one of the documents fed from the table from the others while transporting that document, and a belt for driving the single document onto the glass platen of the copier. A document register roller is located downstream of the separating device in order to feed the document at an adequate time toward the glass platen. The optics is usually disposed below the glass platen to be movable in a reciprocating motion and constituted by a first scanner and a second scanner. While the first scanner is loaded with a lamp and the like and movable at the same speed as a photoconductive element, the second scanner is loaded with mirrors and the like and movable at half the speed of the first scanner. The scanners of the optics individually start moving from their home positions to scan the entire surface of a document which is laid on the glass platen and then return to the home positions. When two or more copies of the same document are desired, the optics is of course reciprocally moved by the number of times which is the same as the number of copies, scanning the document during its forward strokes.

The optics does not scan a document during an interval in which the document is driven from the document register roller to the glass platen and an interval in which the scanners of the optics return to their home positions. While the returning speed of each scanner may be selected to be far higher than the scanning speed, it is impossible to increase the moving speed of the belt. Hence, as the number of copies per document decreases, the proportion of the period of time necessary for moving a document to the total copying time increases resulting in the copying ability (copies per minute of PCM) being reduced. In light of this, when a copier with an ADF is operated to produce one copy with each of a plurality of documents, a sheet-through mode is selected in which a document is moved at a predetermined speed on and along the glass platen to be scanned by the optics which is fixed in place so as to minimize the interruption of operation ascribable to the document moving time. More specifically, the sheet-through mode is such that the scanners of the optics are held in a halt at particular positions below the glass platen to scan a document which is moved over the scanners. This mode is opposite to a sheet-stationary mode in which the optics is movable to scan a document which is laid on the glass platen as previously stated.

A problem with the sheet-through mode is that when a plurality of copies are desired for each document, a document has to be manually removed from the document discharge tray and then loaded in the ADF every time a copy of the document is produced. This not only costs much labor but also aggravates the loss of time to thereby critically lower the copying ability of the copier. Although the labor may be saved by using a recirculation type automatic document feeder (RADF), the loss of time cannot be eliminated.

SUMMARY OF THE INVENTION

It is therefore an object of the present invention to provide a copier with improved copying ability or CPM which automatically selects a sheet-through mode or a sheet-stationary mode to promote effective copying with no regard to the desired number of copies per document, documents being fed by an ADF.

It is another object of the present invention to provide a generally improved copier which is selectively operable in a sheet-through mode and a sheet-stationary mode.

In accordance with the present invention, in a copier comprising optics disposed below a glass platen for exposing a photoconductive element to imagewise light representative of an image which is printed on an original document which is fed to the glass platen, the copier being selectively operable in a sheet-through mode in which a document is moved on and along the glass platen at a predetermined speed relative to the optics which is held in a halt to be scanned by the optics for slit exposure, and a sheet-stationary mode in which the optics is moved at a predetermined speed relative to a document which is held stationary on the glass platen to perform slit exposure, the sheet-through mode and the sheet-stationary mode are respectively automatically selected when a desired number of copies per document is one and when the number of copies per document is two or greater.

BRIEF DESCRIPTION OF THE DRAWINGS

The above and other objects, features, and advantages of the present invention will become more apparent from the following detailed description taken with the accompanying drawings in which.

DESCRIPTION OF THE PREFERRED EMBODIMENT

To better understand the present invention, a brief reference will be made to a prior art electrophotographic copier with an ADF which is constructed to automatically and sequenatilly feed a stack of documents one at a time to a glass platen, scans the document with optics, and discharge the scanned document to a document discharge tray, shown in FIG. 1.

Figure 1:
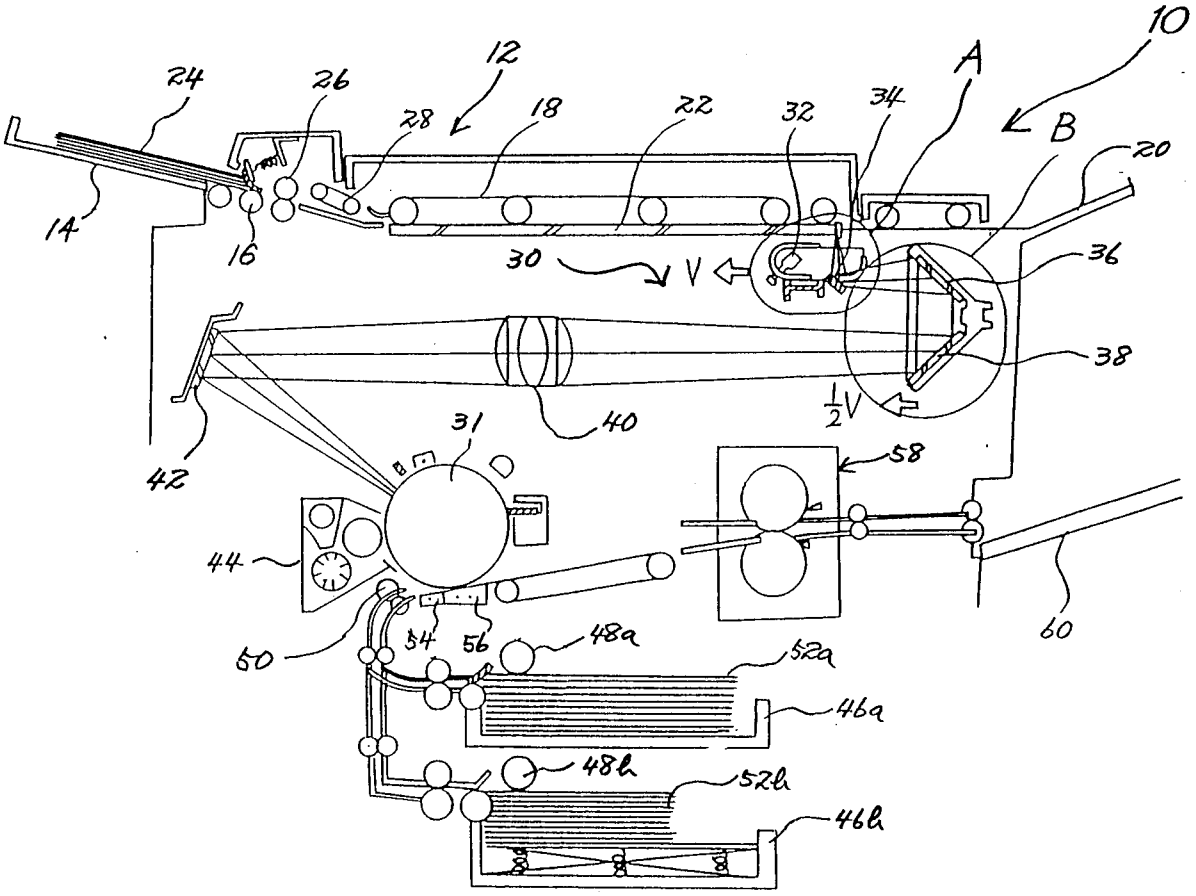
FIG. 1 PRIOR ART
FIG. 1 is a sectional side elevation of a prior art copier which is provided with an ADF and selectively operable in a sheet-through mode and a sheet-stationary mode.

As shown in FIG. 1, the prior art copier, generally 10, is provided with an ADF 12 which generally consists of a document feed table 14, a document separating device 16, a belt 18, and a document discharge tray 20. The belt 18 is so arranged as to make contact with a glass platen 22 of the copier 10. Documents 24 loaded on the table 14 are separated one by one by the separating device 16, then fed by the belt 18 to the glass platen 22 via a document register roller 26 and an intermediate belt 28, then stopped at a predetermined position, and then scanned by optics 30 which is disposed below the glass platen 22. Imagewise light reflected by the document on the glass platen 22 is focused onto a photoconductive drum 31. The document scanned by the optics 30 is further transported by the belt 22 to the discharge tray 20 while, at the same time, the next document is fed to the glass platen 22.

The optics 30 is made up of a first scanner A which carries a lamp 32 and a first mirror 34 therewith, a second scanner B on which a second mirror 36 and a third mirror 38 are mounted, a lens 40, and a fourth mirror 42. While the first scanner A is moved at a predetermined speed V, the second scanner B is moved in synchronism with and in the same direction as the scanner A at half the speed of the scanner A, i. e. V/2. The drum 31 is rotated at a peripheral speed V to be exposed imagewise through a slit. As a result, a latent image is electrostatically formed on the drum 31. The latent image is developed by a developing unit 44 to become a toner image. Paper sheets 52*a* and 52*b* are stacked in paper cassettes 46*a* and 46*b*, respsectively. Any of those paper sheets 52*a* and 52*b* is fed by a feed roller 48*a* or 48*b* which is associated with the paper cassette 46*a* or 46*b* and a register roller 50 to the drum 31, the paper sheet 52*a* or 52*b* being brought into register with the toner image on the drum 31. After the toner image has been transferred from the drum 31 to the paper sheet 52 by a transfer charger 54, the paper sheet 52 is separated from the drum 31 by a separation charger 56, then fixed by a fixing unit 58, and then discharged to a paper discharge tray 60.

When two or more copies are desired for each of the document 24, the document 24 is held stationary on the glass platen and repetitively scanned by the first and second scanners A and B which are moved in a reciprocating motion by the number of times which is the same as the desired number of copies. The scanners A and B scan the document 24 during their forward strokes. The document 24 scanned by the scanners A and B is discharged to the document discharge tray 20. In this mode, the scanners A and B do not scan the document 24 during an interval in which the leading edge of the document 24 is moved from the document register roller 26 to the leading edge (rightmost edge in the figure) of the glass platen 22 and an interval in which the scanners A and B return to their home positions. While the returning speed of each scanner A or B may be selected to be far higher than the scanning speed, it is impossible to increase the moving speed of the belt 22. Hence, as the number of copies per document decreases, the proportion of the period of time necessary for moving a document to the total copying time increases resulting in the copying ability (CPM) being reduced.

In light of this, when the copier 10 with the ADF 12 is operated to produce one copy with each document 24, a sheet-through mode is selected in which the document 24 is moved at a predetermined speed on and along the glass platen 22 to be scanned by the optics 30 which is fixed in place so as to minimize the interruption of operation ascribable to the document moving time. More specifically, the sheet-through mode is such that the scanners A and B are held stationary at particular positions below the glass platen 22 to scan the document 22 which is moved over the scanners A and B.

Figure 2:
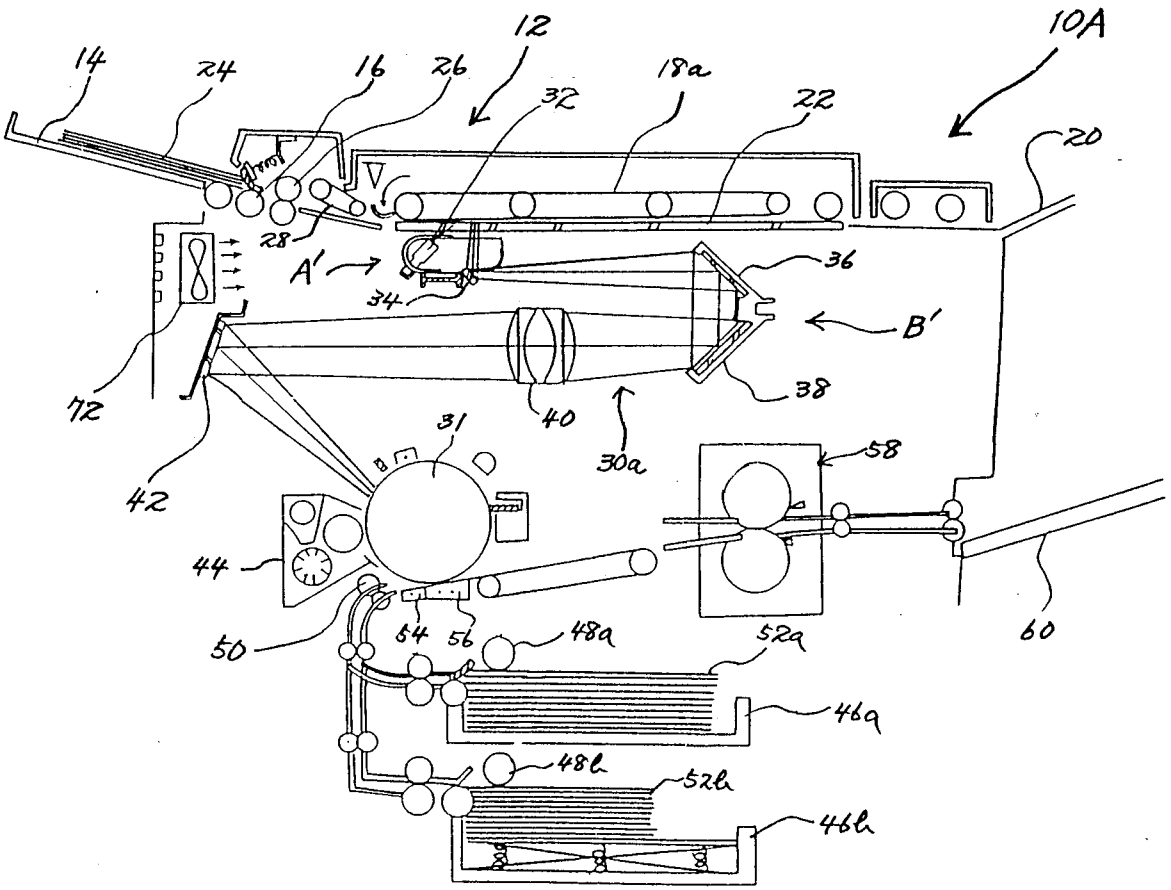
FIG. 2 is a fragmentary sectional side elevation of a copier to which the present invention is applied.
Figure 3:
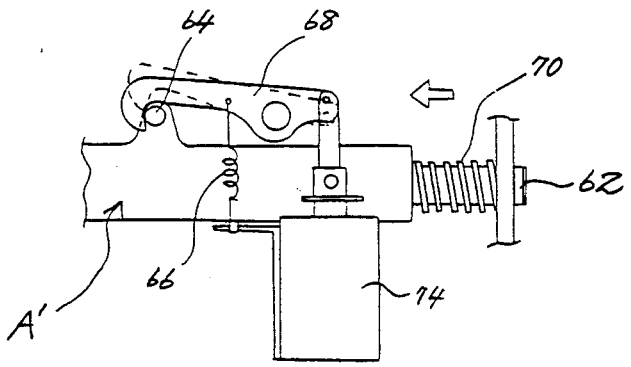
FIG. 3 is a side elevation showing an arrangement for holding a scanner of the copier of FIG. 2 in a halt.

Referring to FIG. 2, there is shown an example of a copier capable of operating in such a sheet-through mode. The copier 10A has an ADF 12 which is the same in construction as the ADF 12 of FIG. 1. A belt 18*a* included in the ADF 12 is movable at a speed which is the same as the document scanning speed V. Optics 30*a* includes a lamp 32, mirrors 34, 36, 38 and 42 and a lens 40 which are arranged in the same manner as those of FIG. 1. The optics 30*a* further includes a first scanner A′ which is usually fixed in place by a locking mechanism which is exemplarily shown in FIG. 3. As shown in FIG. 3, the first scanner A′ is slidably mounted on a guide rod 62. A pin 64 is studded on the scanner A′ while a locking arm 68 having a hook portion is constantly biased counterclockwise by a spring 66, the hook portion being engaged with the pin 64. A spring 70 constantly urges the right end of the scanner A′ to position the scanner A′. The second scanner B′ is interlocked with the first scanner A′ and therefore, in the condition shown in FIG. 3, it is also locked in place. Of course, the copier 10A is provided with a developing unit 44, paper cassettes 46*a* and 46*b*, feed rollers 48*a* and 48*b*, paper register roller 50, a fixing unit 58 and a paper discharge tray 60 which are identical with those of FIG. 1.

The copier 10A with the above construction is operated as follows. The belt 18*a* moves the document 24 at the scanning speed V on and along the glass platen 22 relative to the optics 30*a* which is fixed in place as shown in FIG. 2. At the same time, the drum 31 is rotated at the peripheral speed V to be exposed imagewise through a slit. Since only one portion of the glass platen 22 is continuously illuminated by the optics 30a, a fan 72 is provided for preventing that portion of the glass platn 22 from being heated. A solenoid 74 shown in FIG. 3 is operable to release the locking arm 68 from the pin 64 so that the scanners A′ and B′ may become movable as in the copier 10 of FIG. 1. Specifically, in the case that a document in the form of a book for which the ADF 12 is unfeasible is to be reproduced, the book is held stationary on the glass platen 22 and the locking arm 68 is released as stated above. In this condition, the scanners A′ and B′ are movable to effect slit exposure in the sheet-stationary mode.

A problem with the copier 10A is that when a plurality of copies are desired for each document, a document has to be manually removed from the document discharge tray 20 and then loaded in the ADF 12 every time a copy of the document is produced. This not only costs much labor but also aggravates the loss of time to thereby critically lower the copying ability of the copier 10A.

A preferred embodiment of the copier in accordance with the present invention will be described which is free from the problem discussed above.

The embodiment of the present invention is essentially identical with the copier of FIGS. 2 and FIG. 3 with respect to mechanical arrangement. However, in the illustrative embodiment, when the number of copies per document is one (so-called one-to-one copying), the sheet-through mode is automatically set up. The number of copies may be entered on numeral keys to be set in a preset counter. In the sheet-through mode, the solenoid 74 shown in FIG. 3 is not actuated and the belt 18a is continuously moved at the speed V. Documents 24 are fed one by one from the table 14 at a predetermined timing by the register roller 26 and then scanned by the scanners A' and B' while being transported by the belt 18*a* on and along the glass platen 22. When the number of copies set in the preset counter is two or greater, the solenoid 74 is actuated to allow the scanners A' and B' to move along the guide rod 62. Then, the document 24 is driven by the belt 18*a* and stopped at a predetermined position on the glass platen 22, and the optics 30*a* is reciprocally moved by the number of times which is the same as the desired number of copies. Hence, the document 24 is scanned during each forward stroke of the optics 30a.

Figure 4:
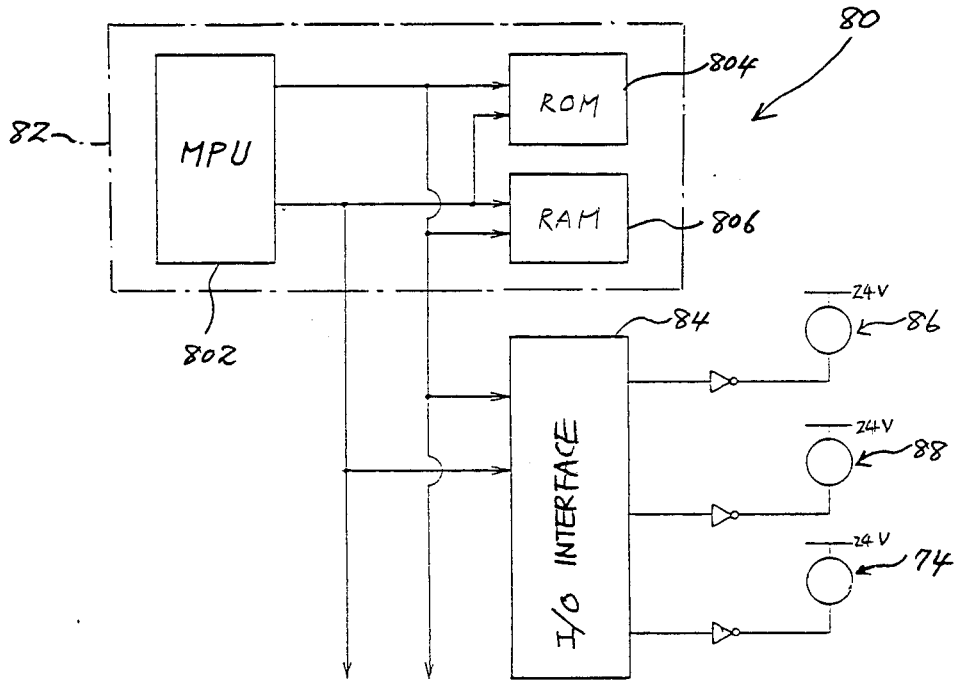
FIG. 4 is a schematic block diagram representative of a control system in accordance with the present invention.
Figure 5:
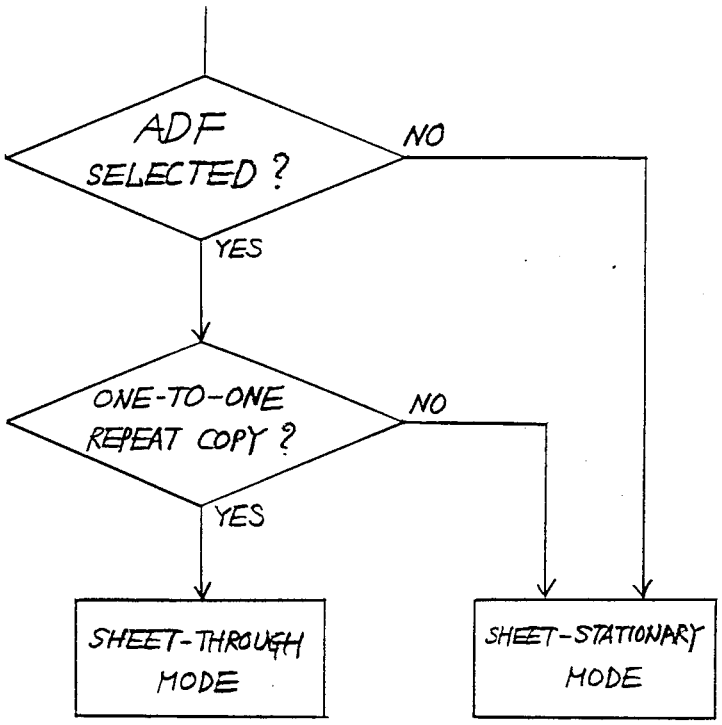
FIG. 5 is a flowchart demonstrating a specific control routine which is executed by the control system of FIG. 4.

FIG. 4 shows a control system 80 included in the illustrative embodiment of the present invention. As shown, the control system 80 consists of a control circuit 82 which is made up of a microprocessor (MPU) 802, a read only memory (ROM) and a random access memory (RAM), and an input/output (I/O) interface 84. Connected to the I/O interface 84 are a document register clutch 86, a paper register clutch 88, and the solenoid 74 of the locking mechanism. The control circuit 80 controls the solenoid 74, document register clutch 86 and paper register clutch 88 as represented by the flowchart of FIG. 5. It is to be noted that when the document is in the form of a book, the ADF 12 is not used and, therefore, the sheet-stationary mode operation is executed.

In summary, it will be seen that the present invention provides a copier which exhibits offers an high copying ability with no regard to the desired number of copies per document.

Various modifications will become possible for those skilled in the art after receiving the teachings of the present disclosure without departing from the scope thereof.

What is claimed is:

1. In a copier comprising optics disposed below a glass platen the process of exposing a photoconductive element to imagewise light representative of an image which is printed on an original document which is fed to said glass platen, said copier being selectively operable in a sheet-through mode in which a document is moved on and along said glass platen at a predetermined speed relative to said optics which is held in a halt to be scanned by said optics for slit exposure, and a sheet-stationary mode in which said optics is moved at a predetermined speed relative to a document which is held stationary on said glass platen to perform slit exposure, the improvement wherein the sheet-through mode and the sheet-stationary mode are respectively automatically selected when a desired number of copies per document is one and when the number of copies per document is two or greater.

2. The copier as claimed in claim 1, wherein one of the sheet-through mode and the sheet-stationary mode is automatically selected when the desired number of copies per document is entered.

3. The copier as claimed in claim 1, further comprising locking means for locking said optics at a predetermined position below said glass platen when the sheet-through mode is selected.

* * * * *